United States Patent [19]

Lindell et al.

[11] 4,325,506

[45] Apr. 20, 1982

[54] REINFORCING ARRANGEMENT FOR IMPROVING THE STRENGTH AND DURABILITY OF A FIREARM HOLSTER

[76] Inventors: James W. Lindell, 10600 E. 109th St., Kansas City, Mo. 64134; Arthur F. Barnett, 12005 E. 55th Terr., Kansas City, Mo. 64133

[21] Appl. No.: 136,102

[22] Filed: Mar. 31, 1980

Related U.S. Application Data

[63] Continuation-in-part of Ser. No. 43,360.

[51] Int. Cl.[3] ..... F41C 33/02

[52] U.S. Cl. ..... 224/243; 150/31; 224/911

[58] Field of Search ..... 224/206, 231–234, 224/238, 243–246, 271, 272, 911, 912, 913, 914; 150/31, 32

[56] References Cited

U.S. PATENT DOCUMENTS

| | | | |
|---|---|---|---|
| 445,216 | 1/1891 | Andrews | 150/31 |
| 726,824 | 4/1903 | Phillips | 224/911 |
| 881,044 | 3/1908 | Audley | 224/911 |
| 1,463,270 | 7/1923 | Lifton | 150/31 |
| 1,547,800 | 7/1925 | Franz | 224/911 |
| 1,876,613 | 9/1932 | Clark | 224/911 |
| 1,933,171 | 10/1933 | Hart | 224/232 |
| 2,408,678 | 10/1946 | Paley | 224/911 |
| 2,546,744 | 3/1951 | Ohlemeyer | 224/911 |
| 2,832,519 | 4/1958 | Ojala | 224/911 |
| 3,200,021 | 8/1965 | Clark | 224/911 |
| 3,252,639 | 5/1966 | Sloan | 224/911 |
| 3,406,884 | 10/1968 | Perkins | 224/911 |
| 3,955,724 | 5/1976 | Perkins | 224/243 |
| 4,076,156 | 2/1978 | Katz | 224/243 |
| 4,079,870 | 3/1978 | Clark | 224/911 |
| 4,101,060 | 7/1968 | Bianchi et al. | 224/911 |

*Primary Examiner*—Stephen Marcus

*Attorney, Agent, or Firm*—Lowe, Kokjer, Kircher, Wharton & Bowman

[57] ABSTRACT

This invention relates to a reinforcing arrangement for strengthening the back seam and outer face of a holster for guns or like items. The reinforcing arrangement of the present invention is comprised of a reinforcing piece which is attached to the inner surface of the holster's outer wall. The reinforcing piece includes a protruding arm which extends outward from the back seam. The protruding arm is folded around the back edge of the holster's outer wall so that a portion of the arm overlaps the outer surface of the outer wall. A rivet is then used to further secure the inner and outer walls of the holster to each other. The rivet passes through a channel which is formed by a hole in the portion of the arm which overlaps the outer surface of the outer wall, a hole in the outer wall of the holster, a hole in the portion of the arm which passes between the back edges of the holster's outer and inner walls, and a hole in the holster's inner wall.

7 Claims, 6 Drawing Figures

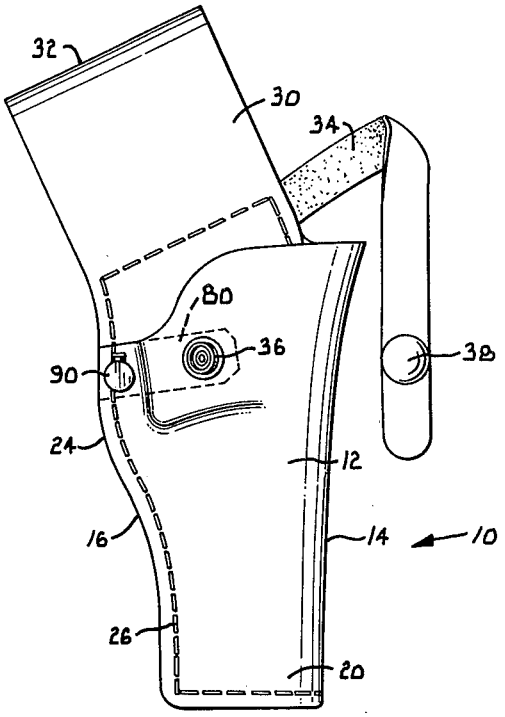
Fig. 4.
Fig. 5.
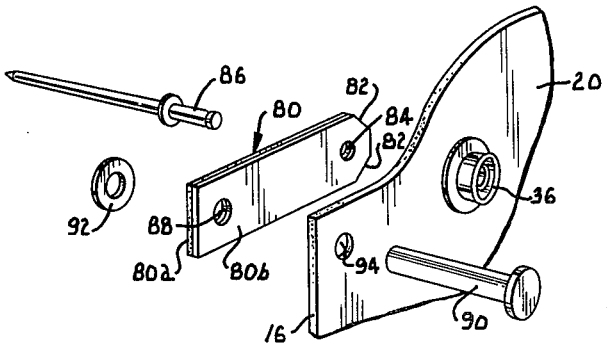
Fig. 6.
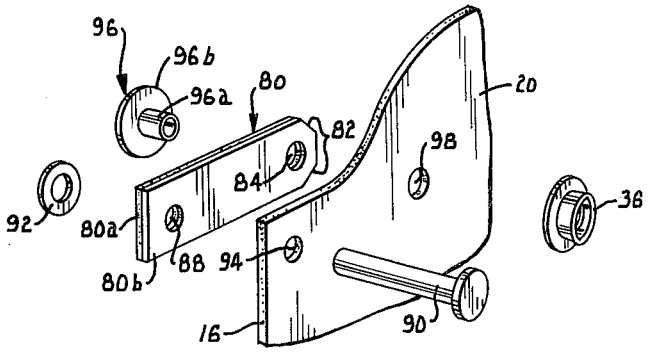

REINFORCING ARRANGEMENT FOR IMPROVING THE STRENGTH AND DURABILITY OF A FIREARM HOLSTER

BACKGROUND AND BRIEF DESCRIPTION OF THE INVENTION

This application is a continuation in part of our prior application Ser. No. 043,360, filed May 29, 1979, now abandoned.

This invention relates in general to holsters for firearms and, in particular, to a unique arrangement for improving the strength and durability of such holsters.

Holsters for removably holding guns and like items are well-known in the art. These holsters are normally comprised of an elongated tubular structure having an open uppermost end for receiving a gun or like item. The tubular structure is typically constructed of a single piece of flexible material such as leather or plastic. This piece of material is usually folded along a vertical edge to position the opposite edges of the pieces adjacent to each other. The edges of the piece are then secured to each other by stitching to form a back seam.

Holsters constructed in this manner have a common defect. In particular, stress applied on the back seam of the holster by pulling the gun backward, downward or outward often causes the leather or stitching of the holster to tear away along the back seam. This problem is aggravated through normal use of the holster. Constant insertion and withdrawal of the gun from the holster causes the leather and stitching along the back seam to wear thereby significantly reducing the strength of the holster at this point. As a result, less force is needed to tear out a used holster than a new one.

The above-mentioned tearing problem is highly undesirable because it shortens the useful life of a holster and presents a serious safety hazard. Normal use of a holster causes considerable wear on the back seam. This wear weakens the back seam causing it to tear out while the rest of the holster is still in good condition. Once the back seam of a holster tears out, the holster must be replaced or repaired at a considerable cost.

The tendency of conventional holsters to tear out along the back seam also presents a serious safety hazard. Each year a large number of police officers, security guards and other people are shot with their own guns. To prevent this scenario, most holsters are equipped with a safety strap which passes over the top of the holster and contacts the gun positioned in the holster to inhibit removal thereof. While this strap serves to deter the unauthorized removal of the gun from the holster, it is still possible for an unauthorized person to remove the gun from the holster without detaching the safety strap by simply pulling on the gun with enough force to tear out the back seam or outer face of the holster. Once a back seam or outer face has been torn out, the unauthorized person can easily remove the gun from the holster with minimal effort.

It is therefore an object of the present invention to provide a reinforcing arrangement which may be incorporated into conventional gun holsters to significantly improve the strength and durability thereof.

An additional object of the present invention is to provide a reinforcing arrangement which may be incorporated into conventional gun holsters to strengthen the back seam of these holsters to thereby improve the security thereof.

Another object of the present invention is to provide a reinforcing arrangement which may be incorporated into conventional gun holsters for significantly improving the strength of the holsters outer wall to thereby improve the strength and security thereof.

Another object of the present invention is to provide a reinforcing arrangement which may be incorporated into conventional gun holsters to strengthen the back seam of these holsters to thereby extend the useful life thereof.

It is an additional object of the present invention to provie a reinforcing arrangement of the character described which is simple and economical to produce and may be quickly and easily installed on conventional holsters.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith and which like reference numerals are employed to indicate like parts in the various views:

FIG. 4 is a front elevational view of a holster which is equipped with a reinforcing strip in accordance with a modified form of the invention, the strip being shown in broken lines;

FIG. 5 is an exploded perspective view of the reinforcing strip shown in FIG. 4 and the associated fastening elements; and FIG. 6 is an exploded perspective view of the modified reinforcing strip and associated fastening elements which may be used to attach it to the holster in an alternative manner.

Figure 1:
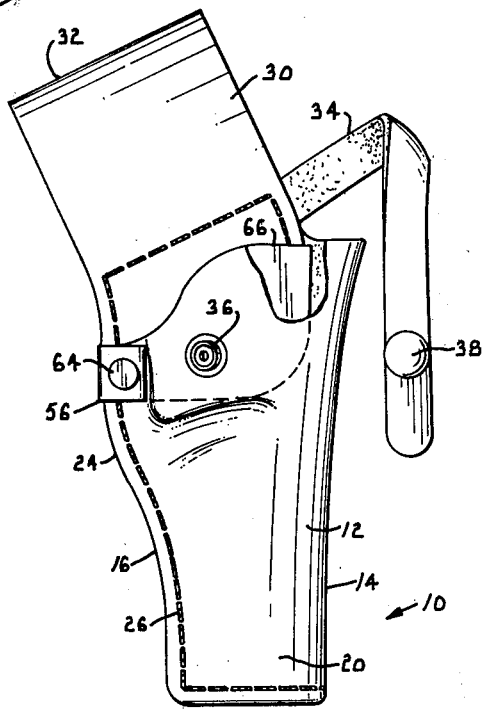
FIG. 1 is a front elevational view of a conventional holster with the reinforcing arrangement of the present invention installed thereon and portions broken away for the purpose of illustration.
Figure 2:
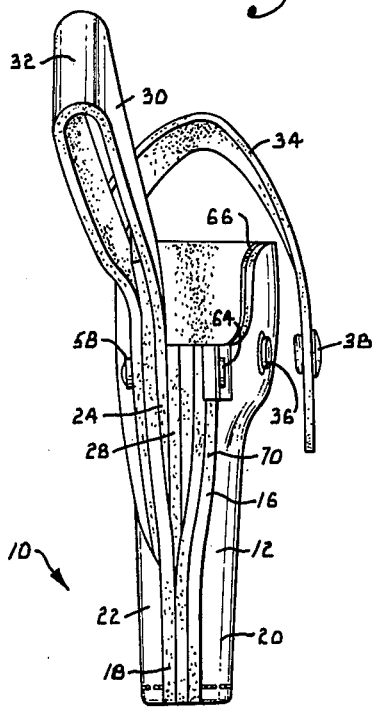
FIG. 2 is a side elevational view of a conventional holster with the reinforcing arrangement of the present invention installed thereon.

Reference is now made to FIGS. 1 and 2 wherein a conventional holster 10 is shown. The holster is comprised of a tubular structure 12 which is open at its uppermost end to receive a gun or like object. Tubular structure 12 is typically constructed of a single piece of pliable material such as leather or the like. This piece of material is folded along a forward edge 14 such that the lateral edges 16 and 18 of the piece are positioned adjacent to each other. In this type of construction, the portions of the tubular structure lying on opposite sides of the edge fold provide an outer wall 20 and an inner wall 22.

The lateral edge 16 of the outer wall 20 and the lateral edge 18 of the inner wall 22 are in turn secured to each other by means of stitching 26 to provide a back seam 24. In addition, an intervening welt 28 is quite often interposed between the stitched edges of the holster. This welt is secured in place by the stitching 26 which is arranged to pass through the welt and the inner and outer walls of the holster. The welt shown herein is constructed to have a size and shape which conform to the outer contour of edges 16 and 18 and is thicker at its uppermost portion than at its lower most portion to shape the holster so that it more nearly conforms to the piston to be used therewith.

The inner wall normally has a belt attaching piece 30 integrally formed with it. The belt attaching piece is comprised of a piece of pliable material such as leather or the like which is folded along an upper edge 32. One side of this piece is attached to the inner surface of the inner wall while the other side of the piece is attached to the outer surface of the inner wall. In addition, a stiffener member is often incorporated into the inner wall of the holster. This member serves a number of functions including that of stiffening the upper portion of the tubular structure in a selected position and form.

A safety strap 34 is normally provided to prevent unauthorized removal of the pistol from the holster. One end of the strap is permanently secured to the inner wall of the holster by means of a rivet which is not shown herein. A releasable fastening means is provided to releasably secure the other ends of the safety strap to the outer surface of the outer wall. This fastening means is comprised of a pair of snap fasteners 36 and 38 which are mounted on the outer wall of the holster and the safety strap, respectfully.

It should be noted at this time that the particular construction of the holster does not form an integral part of this invention. In fact, the reinforcing arrangement of the present invention is suitable to use in combination with any holster which is constructed to have a back seam.

Figure 3:
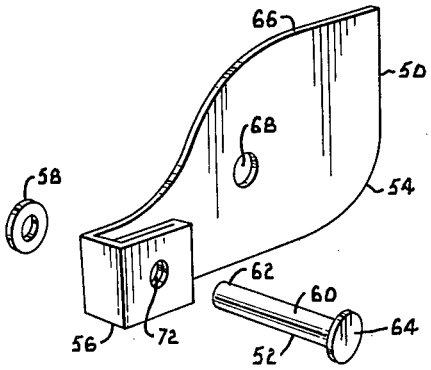
FIG. 3 is an exploded view of the reinforcing arrangement of the present invention.

Reference is now made to FIGS. 1, 2 and 3 for a more detailed description of the reinforcing arrangement of the present invention. As shown in these figures, the reinforcing arrangement is basically comprised of a reinforcing piece 50 and a rivet 52. Reinforcing piece 50 consists of a piece of pliable material which is formed to have an enlarged body portion 54 and a protruding arm portion 56. The rivet 52, on the other hand, is comprised of a mounting washer 58 and a mounting pin 60 consisting of a shaft 62 and an enlarged head 64.

As shown in FIG. 3, the upper edge 66 of the body portion of the reinforcing piece is shaped to follow the outer contour of the upper edge of the holster's outer wall. While the exact size of the reinforcing piece is not a critical aspect of this invention, it is preferable to make the body portion of the piece large enough to cover the chamber of the gun to be used with the holster. In addition, a hole 68 is provided in the body portion of the reinforcing piece.

As shown in FIGS. 1 and 2, the body portion of the reinforcing piece is glued or otherwise attached to the inner surface of the outer wall before the lateral edges of the outer walls are attached to each other. In the preferred embodiment of the invention, the snap fastener passes through hole 68 in the body portion of the reinforcing piece and is mounted to both the outer wall of the holster and the reinforcing piece to thereby provide a stronger connection between the reinforcing piece and the holster's outer wall. The reinforcing piece is attached to the outer wall such that the upper edge of this piece coincides with the upper edge of the outer wall and the protruding arm of this piece passes between the lateral edges of the inner and outer walls and extends outward from the back seam. Once the reinforcing piece has been attached to the inner surface of the outer wall in this manner, the lateral edges of the holster's inner and outer walls are then stitched to each other so that the stitches pass through the portion of the protruding arm which passes between the edges.

The protruding arm is then folded around the back face 70 of lateral edge 16 so that at least a portion of the arm overlaps a portion of the outer surface of the outer wall. The free end of the protruding arm may be folded under the portion of the arm which overlaps the outer surface of the wall as shown in FIG. 3.

Once the reinforcing piece has been attached to the inner wall as described above, the shaft of the rivet is passed through a channel formed by a hole 72 in the portion of the protruding arm which overlaps the outer surface of the outer wall, a hole in the outer wall of the holster, a hole in the portion of the protruding arm which sits between the lateral edges of the inner and outer walls, a hole in the intervening welt, and a hole in the holster's inner wall. The mounting washer is then placed over the portion of the shaft which extends outward from the outer surface of the inner wall. The extending portion of the shaft is then hammered down to provide a second head which secures the rivet in place within the channel and firmly attaches the holster's inner and outer wall to each other.

In use, the reinforcing arrangement of the present invention is installed on a conventional holster as described above. When properly installed, the reinforcing piece and rivet cooperate to significantly strengthen the back seam and outer face of the holster allowing it to withstand greater stress. The reinforcing piece serves to distribute the stress over a larger surface area to thereby relieve most of the pressure placed on the stitching during insertion and removal of the gun from the holster. As a result, the reinforcing arrangement of the present invention is capable of effectively reinforcing a holster's back seam and outer face to thereby improve the strength and durability thereof.

Referring now to FIGS. 4 and 5, a modified reinforcing arrangement is shown. The holster depicted in FIGS. 4 and 5 is substantially identical to that described previously, and the same reference numerals used in FIGS. 1–3 are used in FIGS. 4 and 5 to identify like components.

The embodiment of FIGS. 4 and 5 differs from the first embodiment only in that a modified reinforcing strip 80 is used in place of the strip 50 described previously. Reinforcing strip 80 is a flat flexible strip which is preferably constructed of belting material having an inner leather layer **80*a* bonded flatly to an outer layer 80*b* which is formed of nylon or a similar plastic material. The nylon layer 80*b* provides strength and resistance to tearing, while the leather layer 80*a*** contacts the handgun to prevent any possibility of snagging on the gun or otherwise interfering with removal of the gun from the holster.

Strip 80 is generally rectangular but has chamfered corners 82 at its front end. The front end portion of strip 80 is provided with a circular hole 84 which is large enough to receive the shank of a conventional "pop" rivet 86 used to fasten the reinforcing strip to the holster. The back end portion of strip 80 has a circular hole 88 which is sized to receive a rivet 90 identical to the rivet 52 previously described. A washer 92 identical to washer 58 is used with rivet 90.

The fastening arrangement shown in FIGS. 4 and 5 is used if reinforcing strip 80 is to be added to an existing holster. The existing stitching 26 is cut a short distance below the upper edge of the front wall 12 of the holster to accommodate the back end portion of the reinforcing strip 80 in the seam. The front end portion of strip 80 is pressed flatly against the inside surface of the outer wall 20 of the holster with hole 84 aligned with the hole provided in the snap fastener 36 which is mounted on the holster wall. The pop rivet 86 is then used to fasten the front edge of strip 80 to wall 20. When applied, rivet 86 extends through hole 84 and through the corresponding hole in fastener 36, and in this fashion, the existing snap fastener 36 is utilized to assist in attaching the reinforcing strip to the holster.

The back end of strip 80 is inserted between the back edges of the inner and outer walls of the holster and positioned such that opening 88 is in alignment with an opening 94 formed in outer wall 20 and also in alignment with additional holes in the inner holster wall and the intervening welt or similar structure located between the back edges of the inner and outer walls. The stitching 26 (see FIG. 4) is then applied to the area previously cut to secure the back edge of strip 80, it being noted that the stitching passes through the inner and outer holster walls, the reinforcing strip 80 and the intermediate welt to form the back seam of the holster. Rivet 90 is then passed through opening 94, opening 88, and the aligned openings of the welt and inner wall and is secured in place to assist in attaching the reinforcing strip in place. In this manner, strip 80 is secured in flush extension along the inner surface of wall 20 with leather layer 80*a* facing to the inside for contact with the gun. The position of the strip on the holster is shown in broken lines in FIG. 4, and it is noted that the top edge of the strip extends along the top edge of wall 20 in the area of the back seam. The strip 80 strengthens and reinforces the back seam and outer wall of the holster in essentially the same manner as described previously in connection with FIGS. 1–3.

The fastening arrangement shown in FIG. 6 is used when the reinforcing strip 80 is provided on an original holster. In this case, the front edge of the strip is preferably secured to the holster by a fastening element 96 which serves to mount the snap fastener 36 on wall 20 of the holster. Fastening element 96 is in the form of a rivet having a hollow tubular shank 96*a* and an enlarged flange 96*b* on the head of the shank. Wall 20 of the holster has a hole 98 which is large enough to receive the shank 96*a* of the rivet.

Attachment of strip 80 is carried out by passing the shank 96*a* of fastener 96 through holes 84 and 98 from the inside and also through a central hole in snap fastener 36. The end of shank 96*a* is then enlarged to secure fastener 36 to the outside surface of wall 20. Flange 96*b* serves to hold the front end of strip 80 against the inside surface of wall 20. The back end of the reinforcing strip is attached by stitching 26 and rivet 90 in the same manner indicated previously in connection with FIG. 5.

It should be noted that the reinforcing strip can be attached to the outer surface of wall 20 and still provide the required reinforcement in most cases. Accordingly, the invention contemplates attachment of the strip to the outer surface of the holster.

From the foregoing it will be seen that this invention is one well adapted to attain all the ends and objects herein above set forth together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In a gun holster having a tubular shaped body structure with an open uppermost end, said tubular shaped body structure being formed by an inner wall with a back edge and an outer wall with an inner surface, an outer surface and a back edge wherein the back edge of the inner wall is attached to the back edge of the outer wall to provide a back seam, the improvement therein of a reinforcing arrangement for strengthening said back seam and outer face, said reinforcing arrangement comprising:

a reinforcing piece having a body portion and a protruding arm portion;

said reinforcing piece being attached to said outer wall such that the body portion of said reinforcing piece is in proximity to the open uppermost end of said body structure and such that the protruding arm portion of said reinforcing piece is arranged to extend around the back edge of said outer wall; and a fastener for effectively securing said outer wall to said inner wall.

2. The reinforcing arrangement as in claim 1, wherein said reinforcing piece is attached to said outer wall such that the body portion of said reinforcing piece is attached to the inner surface of said outer wall in proximity to the open uppermost end of said body structure.

3. The reinforcing arrangement as in claim 2, wherein the protruding arm of said reinforcing piece is passed between the back edge of the inner wall and the back edge of the outer wall and is positioned to extend around the back edge of said outer wall such that a portion of the protruding arm portion of said reinforcing piece overlaps a portion of the outer surface of said outer wall.

4. The reinforcing arrangement as in claim 3 wherein said fastener is comprised of a rivet which is arranged to pass through a channel defined by an opening in the portion of said protruding arm which overlaps the outer surface of said outer wall, an opening in said outer wall, an opening in the portion of said protruding arm portion which passes between the back edge of said inner wall and the back edge of said outer wall and an opening in said inner wall.

5. In a gun holster having a generally tubular body with an open top end for receiving a handgun, an outer wall of said body terminating in a back edge, a snap fastener on said outer wall, a safety strap having means to connect with said snap fastener, and an inner wall of said body terminating in a back edge attached to said back edge of the outer wall at a seam, the combination therewith of:

a reinforcing strip having a front end portion and a back end portion located adjacent said seam with said seam securing the back end portion of the strip flush against said outer wall of the holster to reinforce the seam; and a fastening element mounting said snap fastener on said outer wall and also securing said front end portion of said reinforcing strip to said outer wall to secure said reinforcing strip in extension along the outer wall flush therewith.

6. In a gun holster having a generally tubular body with an open top end for receiving a handgun, an outer wall of said body terminating in a back edge, a snap fastener on said outer wall, a safety strap having means to connect with said snap fastener, and an inner wall of said body terminating in a back edge attached to said back edge of the outer wall at a seam, the combination therewith of:

a reinforcing strip having a front end portion and a back end portion located adjacent said seam with said seam securing the back end portion of the strip flush against said outer wall of the holster to reinforce the seam; and a fastening element passing through said snap fastener and outer wall and engaging the front end portion of said reinforcing strip in a manner to secure said front end portion to said outer wall, thereby securing the reinforcing strip in extension along said outer wall flush therewith.

7. In a gun holster having a generally tubular body with an open top end for receiving a handgun, an outer wall of said body terminating in a back edge, and an inner wall of said body terminating in a back edge attached to said back edge of the outer wall along a seam, the combination therewith of:

a reinforcing strip constructed of a tear resistant material, said reinforcing strip having a back end portion located adjacent said seam and a front end portion spaced from the seam;

a first rigid fastening element extending through said front end portion of the reinforcing strip and said outer wall at a location spaced forwardly of said seam; and a second rigid fastening element extending through said back end portion of the reinforcing strip and said outer and inner walls to secure said back end portion to the holster at a location adjacent said seam, thereby reinforcing the seam.

* * * * *